United States Patent [19]

Sasaki

[11] Patent Number: 4,854,767

[45] Date of Patent: Aug. 8, 1989

[54] ASSEMBLY-TYPE BARRICADE

[75] Inventor: Mitsuo Sasaki, Yamato, Japan

[73] Assignee: Just Japan Co., Ltd., Tokyo, Japan

[21] Appl. No.: 149,278

[22] Filed: Jan. 28, 1988

[30] Foreign Application Priority Data

Feb. 13, 1987 [JP] Japan ..... 62-29560

[51] Int. Cl.[4] ..... E01F 13/00

[52] U.S. Cl. ..... 404/6; 404/13; 256/13.1; 256/24; 116/63 P

[58] Field of Search ..... 404/6, 9, 12, 13; 256/13.1, 24; 52/293, 294, 79.1; 446/85, 108, 111-113, 115, 118, 122, 128; 40/605-607, 610-612; 116/63 R, 63 P, 63 C, 63 T

[56] References Cited

U.S. PATENT DOCUMENTS

| | | | |
|---|---|---|---|
| 3,564,984 | 2/1971 | Alexander | 404/9 X |
| 3,603,026 | 9/1971 | Kishigami | 446/122 |
| 3,933,311 | 1/1976 | Lemelson | 256/24 X |
| 3,978,631 | 9/1976 | Diersing | 40/605 |
| 4,030,236 | 6/1977 | Schabel | 446/128 |
| 4,050,401 | 9/1977 | Kelly | 404/6 X |
| 4,183,695 | 1/1980 | Wilcox | 404/6 |
| 4,279,105 | 7/1981 | Cameron | 404/6 X |
| 4,312,600 | 1/1982 | Schaaf et al. | 404/6 |
| 4,372,536 | 2/1983 | Morse | 404/6 X |
| 4,565,042 | 1/1986 | von Poschinger-Camphausen | 446/122 X |
| 4,642,946 | 2/1987 | Koch | 40/611 X |

FOREIGN PATENT DOCUMENTS

| | | | |
|---|---|---|---|
| 828519 | 9/1952 | Fed. Rep. of Germany | 446/111 |

*Primary Examiner*—Stephen J. Novosad
*Assistant Examiner*—John F. Letchford
*Attorney, Agent, or Firm*—Beveridge, DeGrandi & Weilacher

[57] ABSTRACT

An assembly-type barricade comprising a base stand and an upstanding wall both of which are nearly rectangular parallelpipedal. Protruding means is provided in one of the base stand and the upright wall, and receiving means is provided in the other. By positioning the protruding means in the receiving means, the upright wall is detachably mounted on the base stand.

2 Claims, 15 Drawing Sheets

ASSEMBLY-TYPE BARRICADE

FIELD OF THE INVENTION

This invention relates to a barricade to be set up, for example, on a road.

DESCRIPTION OF THE INVENTION

Barricades of various types have been used in construction work. Typical examples are a folding type barricade which can be selectively held in an installed condition and a stored condition, and an insertion-type barricade having leg portions adapted to be inserted in a concrete stand.

However, none of the conventional barricades have proved to be entirely satisfactory, and have various defects. For example, (a) they are liable to tumble down owing to the pressure of wind or by other causes; (b) joint portions linked by welding are liable to break; and (c) they require storage spaces when they are not in use.

SUMMARY OF THE INVENTION

It is a primary object of this invention to provide a novel and excellent assembly-type barricade which is easy to carry and set up and does not require a large storage space.

Another object of this invention is to provide a novel and excellent assembly-type barricade which can be used in many applications.

According to this invention, there is provided an assembly-type barricade comprising a base stand and an upright wall detachably mounted on the base stand.

DETAILED DESCRIPTION OF THE PREFERRED EMBODIMENTS

One specific embodiment of the assembly-type barricade in accordance with this invention will now be described in detail with reference to the accompanying drawings.

Constituent Elements of the Barricade

Figure 1:
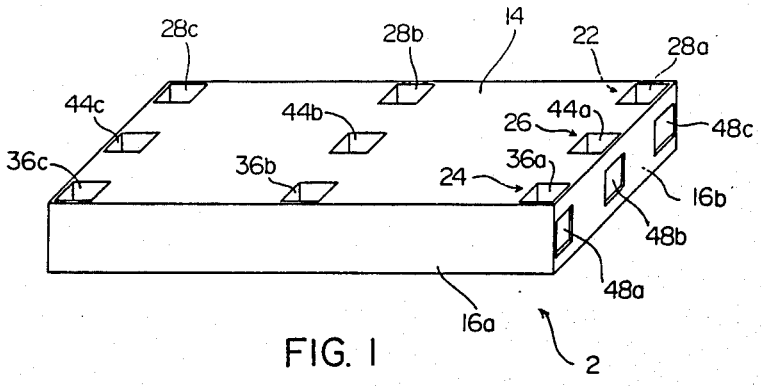
FIG. 1 is a perspective view showing a base stand in the assembly-type barricade of the invention.
Figure 2:
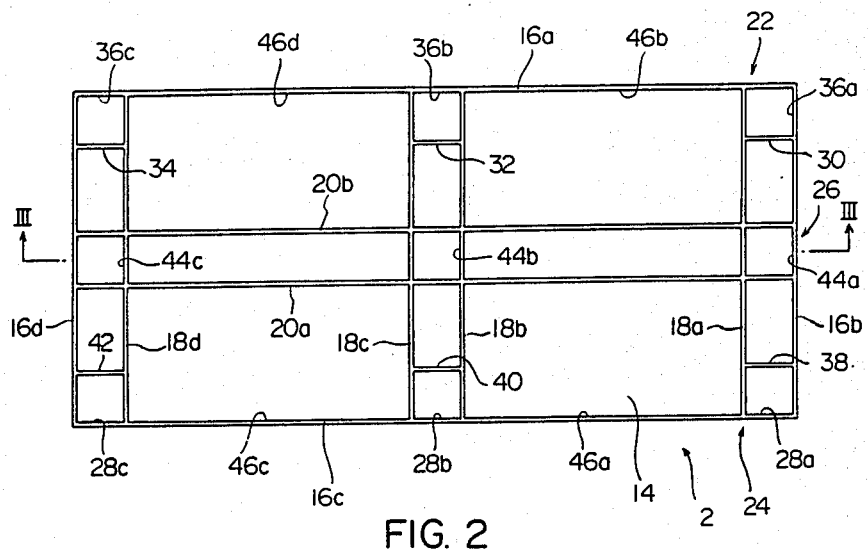
FIG. 2 is a bottom view of the base stand shown in FIG. 1.
Figure 3:
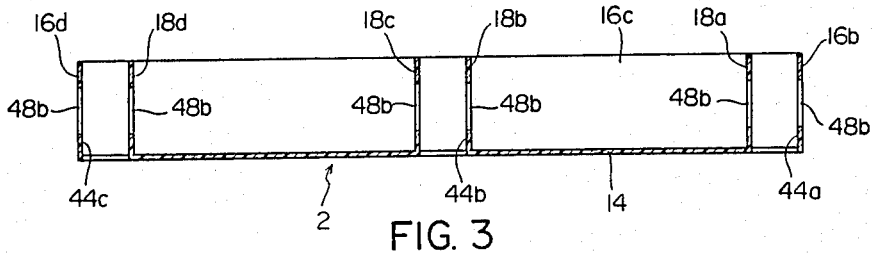
FIG. 3 is a sectional view taken on line III—III of FIG. 2.
Figure 4:
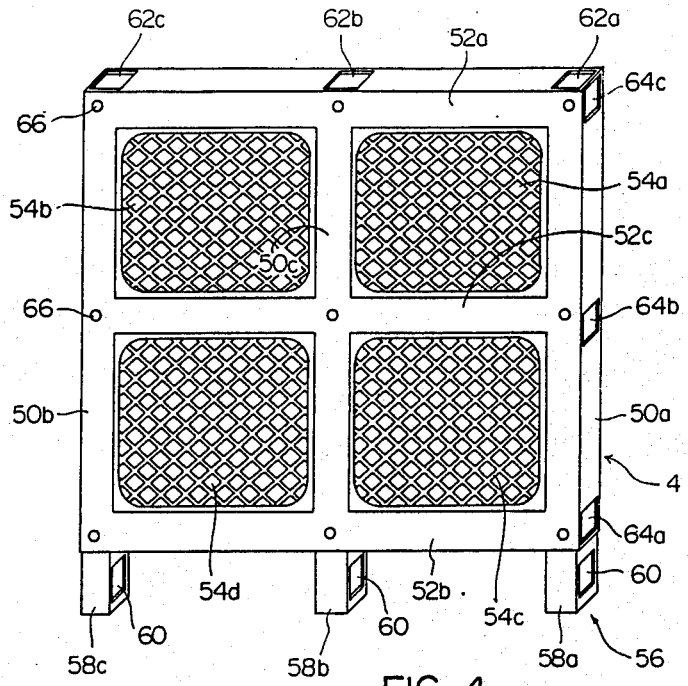
FIG. 4 is a perspective view showing a first form of an upright wall in the assembly-type barricade of the invention.
Figure 5:
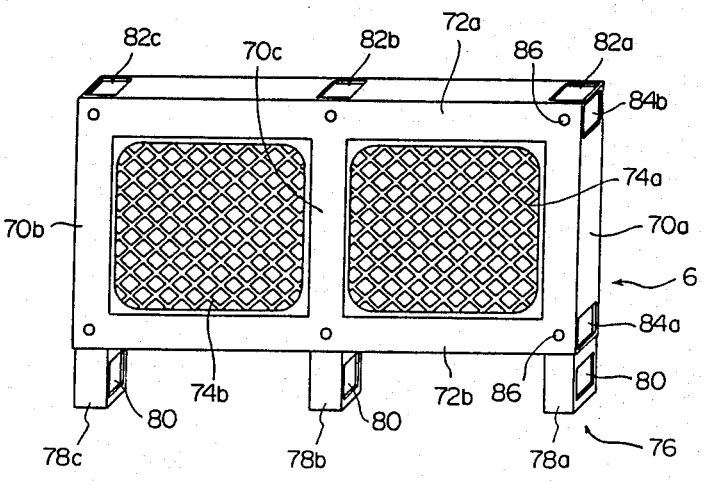
FIG. 5 is a perspective view showing a second form of the upright wall in the assembly-type barricade of the invention.

The illustrated barricade comprises a base stand 2 shown in FIGS. 1 to 3 and a first-type upright wall 4 shown in FIG. 4 or a second-type upright wall 6 shown in FIG. 5. In the illustrated embodiment, the barricade further comprises linking lateral members 8 (FIGS. 14 to 19) for linking the base stand 2 and the first-type upright wall 4 (or the second-type upright wall 6), wall-linking lateral members 10 (FIGS. 14 to 19) for linking the first-type upright wall 4 (or the second-type upright wall 6) and the first-type upright wall 4 (or the second-type upright wall 6), and linking vertical members (FIGS. 11 and 20) for linking the first-type upright wall 4 (or the second-type upright wall 6) to the base stand 2. It will be easily understood from the description hereinafter that the barricade in the specific embodiment can be basically constructed of a combination of the base stand 2 and the first-type upright wall 4, or a combination of the base stand 2 and the second-type upright wall 6.

Structure of the Base Stand

With reference to FIGS. 1 to 3, the structure of the base stand 2 will be described.

The base stand 2 is nearly rectangular parallelpipedal and has a rectangular upper wall 14, and four side walls 16*a*, 16*b*, 16*c* and 16*d* extending downwardly from the four side edges of the upper wall 14. In the illustrated embodiment, four partitioning walls 18*a*, 18*b*, 18*c* and 18*d* are provided between the side walls 16*b* and 16*d* in spaced-apart relationship in a predetermined direction (in the longitudinal direction of the base stand 2, and in the left-right direction in FIGS. 1 to 3). The partitioning wall 18*a* is disposed adjacent to, and inwardly of, the side wall 16*b*, and the partitioning walls 18*b* and 18*c* are disposed nearly centrally between the side walls 16*b* and 16d. The partitioning wall 18*d* is disposed adjacent to, and inwardly of, the side wall 16*d*. A pair of partitioning walls 20*a* and 20*b* spaced from each other in a direction perpendicular to the predetermined direction, are disposed nearly centrally between the side walls 16a and 16c. These partitioning walls 18a, 18b, 18c, 18d, 20a and 20b are each connected to the inside surface of the upper wall 14.

In the illustrated embodiment, three receiving means 22, 24 and 26 are provided in the base stand 2. With reference mainly to FIG. 2, the receiving means 22 is disposed in one side edge portion (the upper side edge portion in FIG. 1) of the base stand 2; the receiving means 24, in another side edge portion (the lower side edge portion in FIG. 1) of the base stand 2 which is opposite to the above one side edge portion; and the receiving means 26, intermediate between the receiving means 22 and 24. The illustrated receiving means 22 is comprised of three assembling depressed portions 28a, 28b and 28c spaced from each other in a predetermined direction at one side edge portion of the base stand 2. The assembling depressed portion 28a is formed of a through hole defined by the side walls 16b and 16c, the partitioning wall 18a, and an auxiliary wall 30 disposed between the side wall 16b and the partitioning wall 18a. The assembling depressed portion 28b is formed of a through hole defined by the side wall 16c, the partitioning walls 18b and 18c and an auxiliary wall 32 disposed between the partitioning walls 18b and 18c. The assembling depressed portions 28c is formed of a through hole defined by the side walls 16c and 16d, the partitioning wall 18d and an auxiliary wall 34 disposed between the side wall 16d and the partitioning wall 18d. The receiving means 24, like the receiving means 22, is comprised of three assembling depressed portions 36a, 36b and 36c spaced from each other in a predetermined direction in the other side edge portion of the base stand 2. The assembling depressed portion 36a is formed of a through hole defined by the side walls 16a and 16b, the partitioning wall 18a and an auxiliary wall 38 disposed between the side wall 16b and the partitioning wall 18a. The assembling depressed portion 36b is formed of a through hole defined by the side wall 16a, the partitioning walls 18b and 18c and an auxiliary wall 40 disposed between the partitioning walls 18b and 18c. The assembling depressed portion 36c is formed of a through hole defined by the side walls 16a and 16b, the partitioning wall 18d and an auxiliary wall 42 disposed between the side wall 16d and the partitioning wall 18d. The receiving means 26, like the receiving means 22 and 24, is comprised of three assembling depressed portions 44a, 44b and 44c. The assembling depressed portion 44a is formed of a through hole defined by the side wall 16b and the partitioning walls 18a, 20a and 20b. The assembling depressed portion 44b is formed of a through hole defined by the partitioning walls 18b, 18c, 20a and 20b. The assembling depressed portion 44c is formed of a through hole defined by the side wall 16d and the partitioning walls 18d, 20a and 20b. In the illustrated embodiment, each of the nine through holes is of a substantially square cross-sectional shape as shown in FIGS. 1 and 2, and a square hole is formed in the upper wall 14 in correspondence to each of these through holes.

As will be described in detail hereinafter, the base stand 2 can be used selectively in a first manner of use shown in FIG. 1 (in which the upper wall 14 is located at the top, and the side walls 16a to 16d and the partitioning walls 18a to 18d and 20a and 20b make contact with the ground or another surface) or in a second manner of use shown in FIGS. 2 and 3 (in which the side walls 16a to 16d and the partitioning walls 18a to 18d, 20a and 20d are positioned at the top, and the upper wall 14 makes contact with the ground or another surface). To enable this selective use, the assembling depressed portions 28a to 28c, 36a to 36c and 44a to 44c in the receiving means 22, 24 and 26 are respectively formed of through holes. When the base stand 2 is to be used only in the first or second manner of use, it is not always necessary to form the assembling depressions 28a to 28c, 36a to 36c and 44a to 44c of the receiving means 22, 24 and 26 form through holes, and they may be mere depressions.

In the second manner of use, the base stand 2 has the following characteristic features. As can be seen from FIGS. 2 and 3, one surface of the base stand 2 has the upper wall 14 but its other surface is open. Hence, the hollow space of the base stand 2 is exposed to outside and can be effectively utilized as a weight accommodating space to be described hereinafter. A depressed portion 46a defined by the side wall 16a and the partitioning walls 18a, 18b and 20a, a depressed portion 46b defined by the side wall 16c and the partitioning walls 18a, 18b and 20b, a depressed portion 46c defined by the side wall 16a and the partitioning walls 18c, 18d and 20a, and a depressed portion 46d defined by the side wall 16c and the partitioning walls 18c, 18d and 20b can mainly be utilized as the weight accommodating space. When no weight accommodating space is required, a bottom wall may be provided in this other open surface.

Linking lateral holes 48a, 48b and 48c are provided further in the base stand 2. The linking lateral hole 48a is provided with regard to the receiving means 24 and is formed in the side walls 16b and 16d and the partitioning walls 18a to 18d so as to extend through the through holes of the receiving means 24 (FIG. 1 shows the linking lateral hole 48a formed in the side wall 16b). The linking lateral hole 48b is provided in regard to the receiving means 26 and is formed in the side walls 16b and 16d and the partitioning walls 18a to 18d so as to extend through the through holes of the receiving means 26 (FIG. 1 shows one formed in the side wall 16b, and FIG. 3 shows its entirety). The linking lateral hole 48c is formed with regard to the receiving means 22, and formed in the side walls 16b and 16d and the partitioning walls 18a to 18d. These lateral holes 48a, 48b and 48c are formed in a substantially square shape.

Structure of the First-type Upright Wall

With reference to FIG. 4, the structure of the first-type upright wall 4 will be described. The illustrated upright wall 4 is nearly rectangular parallelpipedal and has a pair of end vartical columnar portions 50a and 50b and an intermediate vertical columnar portion 50c therebetween. The upper ends of the vertical columnar portions 50a to 50c are connected by an upper lateral columnar portion 52a, and the lower ends of these columnar portions 50a to 50c, by a lower lateral columnar portion 52b. The vertical intermediate portions of the columnar portions 50a to 50c are connected by an intermediate lateral columnar portion 52c. In the illustrated embodiment, the vertical columnar portions 50a to 50c and the lateral columnar portions 52a to 52c have an outside shape substantially square in section, and their insides are hollow with a substantially square shape in section.

Preferably, a greater portion of the upright wall 4 is of a mesh structure. In the illustrated embodiment, portions excluding the vertical columnar portions 50a to 50c and the lateral columnar portions 52a to 52c, namely wall portions 54a, 54b, 54c and 54d, are in a mesh shape. The mesh shape permits wind to pass through the wall portions 54a to 54d, and thus prevent the upright wall 4 from tumbling down by the pressure of the wind.

In the illustrated embodiment, protruding means 56 is provided in correspondence to the receiving means 22 (24, or 26) provided in the base stand 2. The illustrated protruding means 56 is comprised of three assembling protrusions 58a, 58b and 58c provided in the lower end of the upright wall 4 in spaced-apart relationship in a predetermined direction (in the longitudinal direction of the upright wall 4, and in the left-right direction in FIG. 4). The assembling protrusion 58a is provided correspondingly to the assembling depressed portion 28a (36a or 44a) existing in the right end portion of the base stand 2 in FIGS. 1 and 2, and projects downwardly from the lower end of the end vertical columnar portion 50a. The assembling protrusion 58b is provided correspondingly to the assembling depressed portion 28b (36b or 44b) existing nearly centrally in the base stand 2 in the left-right direction in FIGS. 1 and 2, and projects downwardly from the lower end of the intermediate vertical columnar portion 50c. The assembling protrusion 58c is provided correspondingly to the assembling depressed portion 28c (36c or 44c) existing in the left end portion of the base stand 2 in FIGS. 1 and 2 and projects downwardly from the lower end of the end vertical columnar portion 50b. Each of the assembling protrusions 58a to 58c is substantially square in cross-section in correspondence to each of the through holes defined in the base stand 2, and its outside shape is slightly smaller than the outside shape of each of the vertical columnar portions 50a to 50c (see FIGS. 4, 8 and 9). Accordingly, the protruding means 56 (more specifically the assembling protrusions 58a, 58b and 58c) may be selectively inserted into any of the receiving means 22 (specifically, the assembling depressed portions 28a, 28b and 28c), the receiving means 24 (specifically, the assembling depressed portions 36a, 36b and 36c) and the receiving means 26 (specifically, the assembling depressions 44a, 44b and 44c).

In the illustrated embodiment, having regard to the linking lateral holes 48a to 48c provided in the base stand 2, a linking lateral hole 60 is also provided in the protruding means 56 in the upright wall 4. The linking lateral hole 60 is substantially square in shape and extends through the assembling protrusions 58a to 58c. It will be easily appreciated therefore that when the protruding means 56 of the upright wall 4 is positioned in place in the receiving means 22 (24 or 26), the linking lateral hole 60 formed in the protruding means 56 is kept in alignment in the aforesaid predetermined direction with the linking lateral hole 48c (48a or 48b) formed in relation to the receiving means 22 (24 or 26) of the base stand 2.

In the illustrated upright wall 4, there are further provided linking vertical holes 62a, 62b and 62c are linking lateral holes 64a, 64b and 64c. The linking vertical hole 62a extends vertically through the end vertical columnar portion 50a and the assembling protrusion 56a: the linking vertical hole 62b extends vertically through the intermediate vertical columnar portion 50c and the assembling protrusion 58b: and the linking vertical hole 62c extends vertically through the end vertical columnar portion 50b and the assembling protrusion 58c. These linking vertical holes 62a to 62c are substantially square in cross-section. It will be understood from the description given hereinafter that the through holes defining the assembling depressed portions 28a to 28c, 36a to 36c and 44a to 44c in the base stand 2 also act as linking vertical holes, and therefore that when the protruding means 56 of the upright wall 4 is positioned in place in the receiving means 22 (24 or 26), the linking vertical holes 62a to 62c of the upright wall 4 vertically communicate with the through holes defining the assembling depressed portions 28a, 28b and 28c of the base stand 2. The linking vertical holes 62a to 62c also act as assembling depressed portions. Specifically, as can be seen from FIG. 4, the linking vertical holes 62a to 62c correspond to the assembling protrusions 58a to 58c provided in the lower end of the upright wall 4, and by positioning assembling protrusions of another upright wall 4 in the linking vertical holes 62a to 62c, the upright walls 4 of the first type can be stacked vertically (a second-type upright wall 6 to be described can also be stacked on it).

The linking lateral hole 64a laterally extends through the lower lateral columnar portion 52b. The linking lateral hole 64b laterally extends through the intermediate lateral columnar portion 52c. The linking lateral hole 64c laterally extends through the upper lateral columnar portion 52a. These linking lateral holes 64a to 64c are substantially square in cross-section. Having regard to the linking lateral hole 64c, the first-type upright wall 4 is also constructed such that when assembling protrusions of another upright wall (the first-type or the second-type) are positioned in place in the linking vertical holes 62a to 62c, the linking lateral hole 64c of the upright wall 4 is kept in alignment laterally with a linking hole (not shown) formed in the assembling protrusions of the other upright wall.

In the illustrated embodiment, a relatively small hole 66 is formed at suitable positions (nine positions in the drawings) in the upright wall 4. These holes may be utilized to suspend a plate or the like by means of wires passed through them.

Structure of the Second-type Upright Wall

Now, with reference to FIG. 5, the structure of the illustrated second-type upright wall 6 will be described. The second-type upright wall 6 is of substantially the same structure as the first-type upright wall 4 from which an upper portion existing above the intermediate lateral columnar portion 52c (the upper lateral columnar portion 52a and the mesh-like wall portions 54a and 54b) is removed.

In FIG. 5, the upright wall 6 is nearly rectangular parallelpipedal and has a pair of end vertical columnar portions 70a and 70b and an intermediate vertical columnar portion 70c intermediate between them. The upper ends of the vertical columnar portions 70a to 70c are connected to each other by means of an upper lateral columnar portion 72a, and their lower ends are connected by a lower lateral columnar portion 72b. In the illustrated embodiment, the outer shape of each of the vertical columnar portions 70a to 70c and the lateral columnar portions 72a and 72b is substantially square in cross section, and the inside of each of these portions is hollow and substantially square in cross section.

Preferably, a greater portion of the upright wall 6 is in a mesh shape. In the illustrated embodiments, those portions excepting the vertical columnar portions 70a to 70c and the lateral columnar portions 72a and 72b, namely wall portions 74a and 74b, are in a mesh shape.

Protruding means 76 is also provided in this upright wall 6 in correspondence to the receiving means 22 (24, 26) provided in the base stand 2. The illustrated protruding means 76 is comprised of three assembling protrusions 78a, 78b and 78c provided in the lower end of the upright wall 6 is spaced-apart relationship in a predetermined direction (in the longitudinal direction of the upright wall 6, and in the left-right direction in FIG. 5). The assembling protrusion 78a is provided in correspondence to the assembling depressed portion 28a (36a or 44a) in the base stand 2 and projects downwardly from the lower end of the end vertical columnar portion 70a. The assembling protrusion 78b is provided in correspondence to the assembling depressed portion 28b (36b or 44b) of the base stand 2, and projects downwardly from the lower end of the intermediate vertical columnar portion 70b. The assembling protrusion 78c is provided in correspondence to the assembling depressed portion 28c (36c or 44c) of the base stand 2, and projects downwardly from the lower end of the end vertical columnar portion 70c. The assembling protrusions 78a to 78c are substantially square in cross section corresponding to the through holes formed in the base stand 2, and their outside shapes are slightly smaller than the outside shapes of the vertical columnar portions 70a to 70c. Accordingly, the protruding means 76 (comprised of the assembling protrusions 78a, 78b and 78c) can be selectively inserted into any of the receiving means 22 (comprised of the assembling depressed portions 28a, 28b and 28c), the receiving means 24 (comprised of the assembling depressed portions 36a, 36b and 36c), and the receiving means 26 (comprised of the assembling depressed portions 44a, 44b and 44c). Furthermore, as will be easily understood from the above description, the protruding means 76 can also be inserted into the linking vertical holes 62a, 62b and 62c provided in the first-type upright wall 4.

A substantially square linking lateral hole 80 is formed in the protruding means 76 of the upright wall 6 (the assembling protrusions 78a to 78c). When the protruding means 56 is positioned in place in the receiving means 22 (24 or 26) of the base stand 2, the linking lateral hole 80 is kept in alignment with the linking lateral hole 48c (48a or 48b) (FIG. 1) in the aforesaid predetermined direction. When the protruding means 56 is positioned in place in the linking vertical holes 62a to 62c of the upright wall 4 of the first type, the linking lateral hole 80 is kept in alignment with the linking lateral hole 64c (FIG. 4) provided in the upright wall 4 in the aforesaid predetermined direction.

The upright wall 6 has further provided therein linking vertical holes 82a, 82b and 82c and linking lateral holes 84a and 84b. The linking vertical hole 82a extends vertically through the end vertical columnar portion 70a and the assembling protrusion 78a; the linking vertical hole 82b, through the intermediate columnar portion 70c and the assembling protrusion 78b; and the linking vertical hole 82c, through the end vertical columnar portion 70b and the assembling protrusion 78c. The linking vertical holes 82a to 82c are substantially square in cross section. Hence, when the protruding means 76 in the upright wall 6 is positioned in place in the receiving means 22 (24 or 26) in the base stand 2, the linking vertical holes 82a to 82c in the upright wall 6 communicate vertically with the through holes defining the assembling depressed portions 28a, 28b and 28c in the base stand 2. The linking vertical holes 82a to 82c also act as assembling depressed portions at the time of stacking upright walls (the first and second types). Specifically, as can be seen from FIG. 5, the linking vertical holes 82a to 82c correspond to the assembling protrusions 78a to 78c provided at the lower end of the upright wall 6. Hence, by positioning the assembling protrusions of another upright wall in the linking vertical holes 82a to 82c, the second-type upright walls 6 may be stacked vertically. It will further be understood easily from the foregoing description that by positioning the assembling protrusions 58a to 58c (FIG. 4) of the first-type upright wall in the linking vertical holes 82a to 82c, the first-type upright wall 4 may be stacked onto the second-type upright wall 6.

The linking lateral hole 84a extends laterally through the lower lateral columnar portion 72b, and the linking lateral hole 84b extends laterally through the upper lateral columnar portion 72a. The linking lateral holes 84a and 84b are substantially square in cross section. When assembling protrusions of another upright wall (of the first or second type) are positioned in place in the linking vertical holes 82a to 82c, the linking lateral hole 84b of the upright wall 6 is kept in alignment in a predetermined direction (i.e., laterally) with a linking lateral hole (not shown) formed in the assembling protrusions in the other upright wall.

Relatively small holes 86 are formed at suitable positions (in six positions in the drawings) for the same purpose as the small holes 66 formed in the first-type upright wall.

Structure of Linking Lateral Member and Linking Vertical Member

In the illustrated embodiment, there are provided linking lateral members 8 (FIGS. 14 to 19), wall-linking lateral members 10 (FIGS. 14 to 19), and a linking vertical members 12 (FIGS. 11 to 20) which are of substantially the same structure and are formed of a hollow circular tubular member. The outside diameters of the linking lateral members 8, the wall-linking lateral members 10 and the linking vertical members 12 are substantially the same as, or slightly smaller than, one side of the linking vertical holes (62a to 62c, 82a to 82c) and various linking lateral holes (48a to 48c, 64a to 64c, and 84a to 84b). The linking lateral members 8, the wall-linking lateral members 10 and the linking vertical members 12 may be formed of a material whose outside shape is substantially square in cross section instead of the material whose outside shape is substantially circular in cross section. Thus, the linking lateral members 8 can be fitted through the linking lateral holes 48a (48b and 48c) formed in the base stand 2 and the linking lateral hole 60 formed in the upright wall 4 (or the linking lateral hole 80 formed in the upright wall 6) in order to link the base stand 2 and the first-type upright wall 4 (the second-type upright wall 6), and further through the linking vertical holes 62a to 62c and the linking lateral holes 64a to 64c of the first-type upright wall 4 (or the linking vertical holes 82a to 82c and the linking lateral holes 84a and 84b of the second-type upright wall 6). To link the first-type upright wall 4 (or the second-type upright wall 6) and the first-type upright wall (or the second-type upright wall 6), the wall linking lateral members 10 may be fitted through the linking lateral holes 64a to 64c of the first-type upright wall 4 (or the linking lateral holes 84a and 84b of the second-type upright wall 6) and the linking lateral holes 64a to 64c of the first-type upright wall 4, further through the linking lateral hole 60 formed in the assembling protrusions 58a to 58c (or the linking lateral holes 84a and 84b of the second-type upright wall 6, and further linking lateral hole 80 formed in the assembling protrusions 78*a* to 78*c*), and further through the linking lateral holes 48*a* to 48*c* of the base stand 2 and the linking vertical holes 62*a* to 62*c* of the first-type upright wall 4 (or the linking vertical holes 82*a* to 82*c* of the second-type upright wall 6). The linking vertical members 12, in order to link the base stand 2 (or the first-type upright wall 4 or the second-type upright wall 6) and the first-type upright wall 4 (or the second-type upright wall 6), may be fitted through the assembling linking depressed portions 28*a* to 28*c* (36*a* to 36*c* or 44*a* to 44*c*) of the base stand 2 (or the linking vertical holes 62*a* to 62*c* of the first-type upright wall 4 or the linking vertical holes 82*a* to 82*c* of the second-type upright wall 6) and the linking vertical holes 62*a* to 62*c* of the first-type upright wall 4 (or the linking vertical holes 82*a* to 82*c* of the second-type upright wall 6), and also through the linking lateral holes 48*a* to 48*c* of the base stand 2 and the linking lateral holes 60 and 64*a* to 64*c* of the first-type upright wall 4 (or the linking lateral holes 80, 84*a* and 84*b* of the second-type upright wall 6).

It will be understood from the foregoing description that different types of circular tubular materials of different lengths may be used as the linking lateral members 8, the wall linking lateral members 10 and the linking vertical members 12.

Materials for the Various Elements

With reference to FIGS. 1 to 5, the base stand 2, the first-type upright wall 4 and the second-type upright wall 6 may be formed of synthetic resin materials such as vinyl chloride resins, acrylic resins, polypropylene, polyethylene, polycarbonate and polystyrene. The use of these plastic materials makes it possible to reduce their weight and to perform assembling, disassembling, carrying, etc. easily. Furthermore, this increases durability, and cleaning of these members is also easy. The cost of production can also be reduced. It can be easily seen from FIGS. 1 to 5 that the base stand 2 and upright walls 4 and 6 can be easily produced by injection molding or extrusion molding.

On the other hand, the linking lateral member 8, the wall linking lateral member 10 and the linking vertical member 12 are preferably formed of a metallic material such as steel. By forming these members from steel or the like, the base stand 2, the first-type upright wall 4 and the second-type upright wall 6 can be linked accurately. They also act as a weight for the relatively lightweight base stand 2 and upright walls 4 and 6 and increases the weight of a barricade assembled from these members. They also make it possible to lower the center of gravity of the barricade and prevent it from being tumbled down by the pressure of the wind or otherwise.

By constructing the aforesaid base stand 2 and first-type and second-type upright walls 4 and 6 in sizes to be mentioned below, they can be conveniently used as barricades for construction works, for example.

Base stand 2
Longitudinal length: 800 mm
Lateral length: 400 mm
Height: 120 mm
One side of the assembling depressed portion: 60 mm
One side of the linking lateral hole: 50 mm
First-type upright wall 4
Longitudinal length: 800 mm
Lateral length: 68 mm
Height (excepting the assembling protrusions): 700 mm
One side of the vertical columnar portion: 68 mm
One side of the lateral columnar portion: 68 mm
Length of the assembling protrusion: 100 mm
One side of the assembling protrusion: 58 mm
Longitudinal length of the wall portion: 298 mm
Height of the wall portion: 248 mm
One side of the linking lateral hole: 50 mm
One side of the linking vertical hole: 60 mm
Second-type upright wall 6
Longitudinal legnth: 800 mm
Lateral length: 68 mm
Height (excepting the assembling protrusions): 384 mm
One side of the vertical columnar portion: 68 mm
One side of the lateral columnar portion: 68 mm
Length of the assembling protrusion: 100 mm
One side of the assembling protrusion: 58 mm
Longitudinal length of the wall portion: 298 mm
Height of the wall portion: 248 mm
One side of the linking lateral hole: 50 mm
One side of the linking vertical hole: 60 mm
Linking lateral members 8, wall-linking lateral members 10 and linking vertical members 12
Outside diameter: 48.5 mm

Examples of Assembling the Various Constituents Elements

In the illustrated embodiments, barricades of various types can be constructed by detachably assembling the base stand 2, the first-type upright wall 4 and the second-type upright wall 6 in various ways. With reference to FIGS. 6 to 20, typical examples of barricades built by variously assembling the base stand 2, the first-type upright wall 4 and the second-type upright wall 6 will be described.

First Assembling Example

Figure 6:
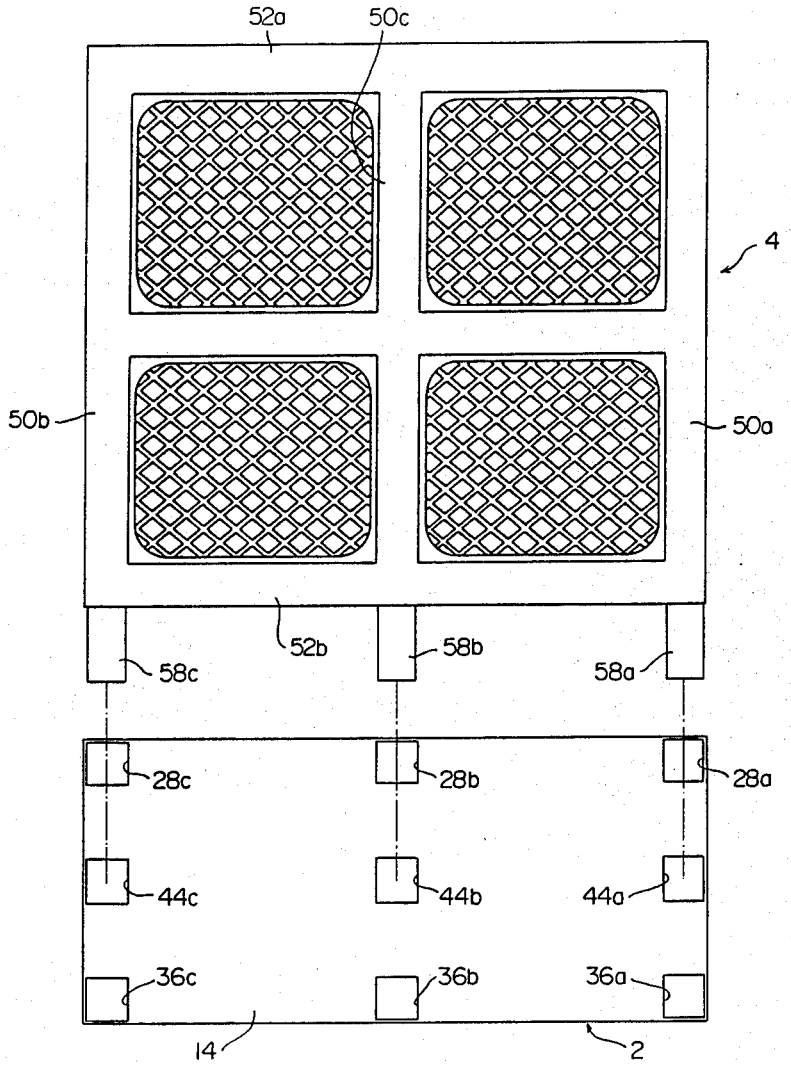
FIG. 6*a* and FIG. 6*b* are views for illustrating the manner of setting up the assembly-type barricade of the invention in a first assembling example.
Figures 6A, 6B:
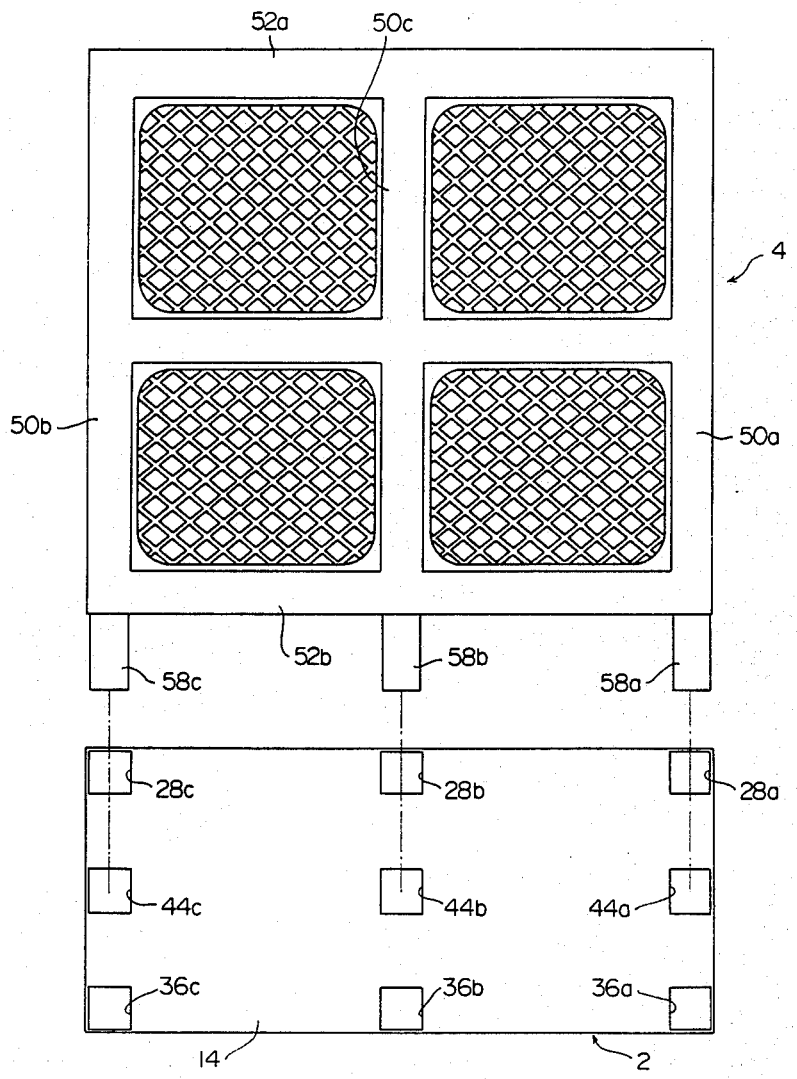
Figure 7:
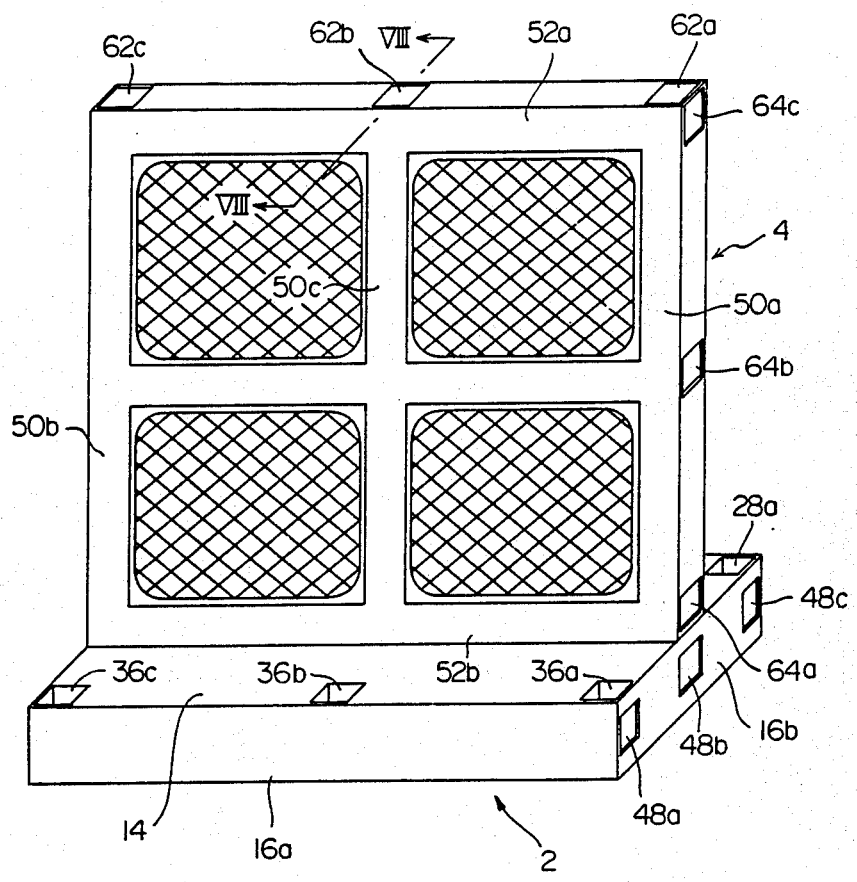
FIG. 7 is a perspective view showing the first assembling example of the assembly-type barricade of the invention.
Figure 9:
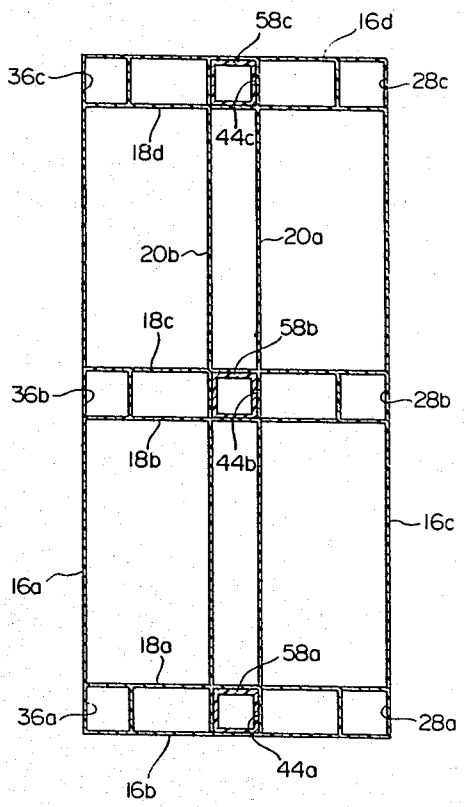
FIG. 9 is a sectional view taken on line IX—IX of FIG. 8.
Figure 8:
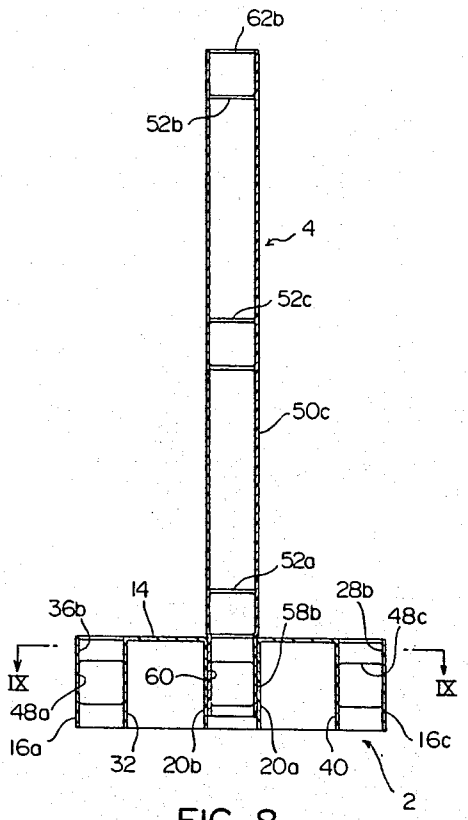
FIG. 8 is a sectional view taken on line VIII—VIII in FIG. 7.

FIGS. 6 to 9 show a first assembling example using a combination of the base stand 2 and the first-type upright wall 4. In this first assembling example, the base stand 2 is used in the first mode of use (in which the upper wall 14 is positioned upwardly), and the protruding means 56 of the upright wall 4 is inserted into the receiving means 26 of the base stand 2 from above, as shown in FIGS. 6*a*, 6*b* and 7. Consequently, as shown in FIGS. 7 to 9, the upright wall 4 is detachably set up. This example of assembling constitutes a basic form of the barricade.

In this basic from, the assembling protrusions 58*a* to 58*c* are received in the assembling depressed portions 44*a* to 44*c* of the base stand 2, and therefore, the upright wall 4 extends substantially vertically from the central part of the base stand 2 in the lateral direction. Since the base stand 2 projects laterally toward both sides of the upright wall 4, the barricade is stable and difficult of tumbling down.

When it is desired to lower the height of the barricade, the second-type upright wall 6 is detachably mounted instead of the first-type upright wall 4.

Second Assembling Example

Figure 11:
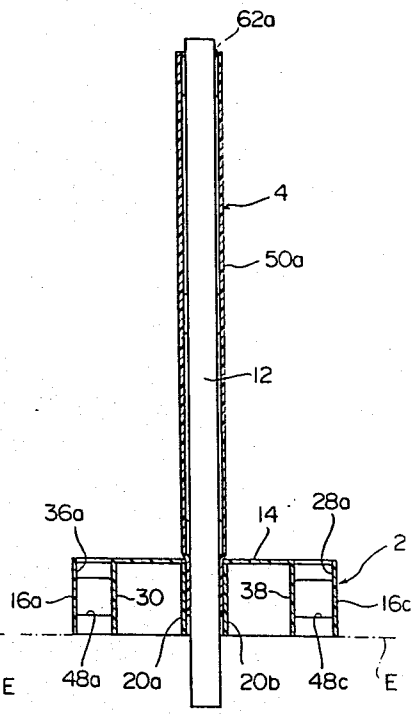
FIG. 11 is a sectional view taken on line XI—XI in FIG. 10.
Figure 10:
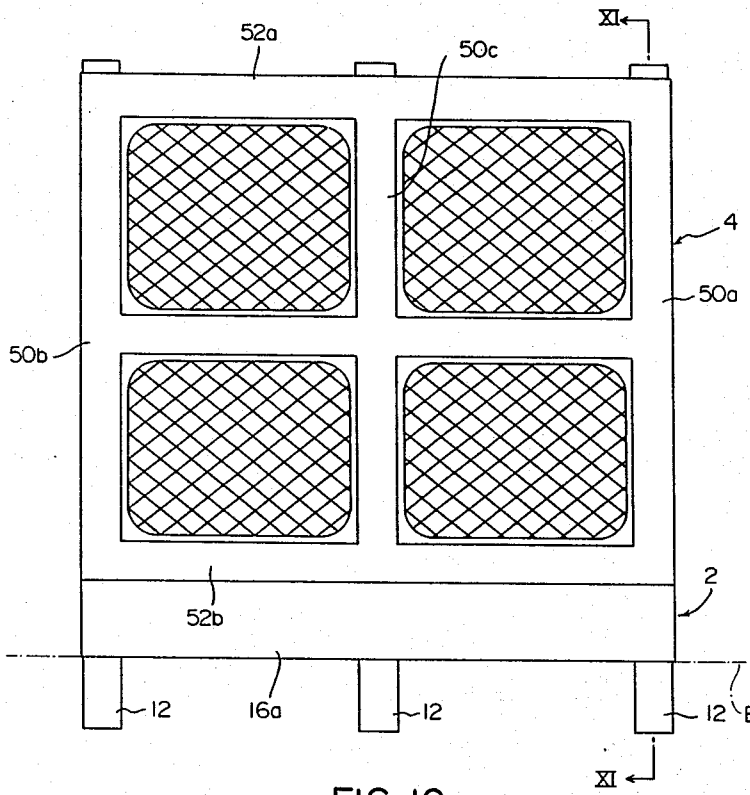
FIG. 10 is a front view showing a second assembling example of the assembly-type barricade of the invention.

FIGS. 10 and 11 show a second assembling example using a combination of the base stand 2, the first-type upright wall 4 and the linking vertical members 12. In the second assembling example, the base stand 2 and the first-type upright wall 4 are assembled as shown in FIGS. 6 to 9, and then the linking vertical members 12 are detachably fitted through the upright wall 4 and the base stand 2. Specifically, the linking vertical members 12 are inserted from above into the linking vertical holes 62*a* to 62*c* formed in the upright wall 4 and the assembling depressed portions 44*a* to 44*c* in the base stand 2, and the lower end portions of the linking vertical members 12 are embedded in the ground E, for example.

Since the linking vertical members 12 are fitted through the upright wall 4 and the base stand 2 in this second assembling example, the upright wall 4 can be mounted on the base stand 2 more accurately. Furthermore, since the lower end portions of the linking vertical members 12 are embedded in the ground E, the barricade is prevented more accurately from tumbling down by the pressure of the wind or otherwise.

In the second example shown in FIGS. 10 and 11, the linking vertical members 12 are fitted through all of the linking vertical holes 62*a* to 62*c* formed in the upright wall 4. The desired effect, however, can also be achieved by fitting one linking vertical member 12 through any one of the linking vertical holes 62*a* to 62*c*.

Third Assembling Example

Figure 13:
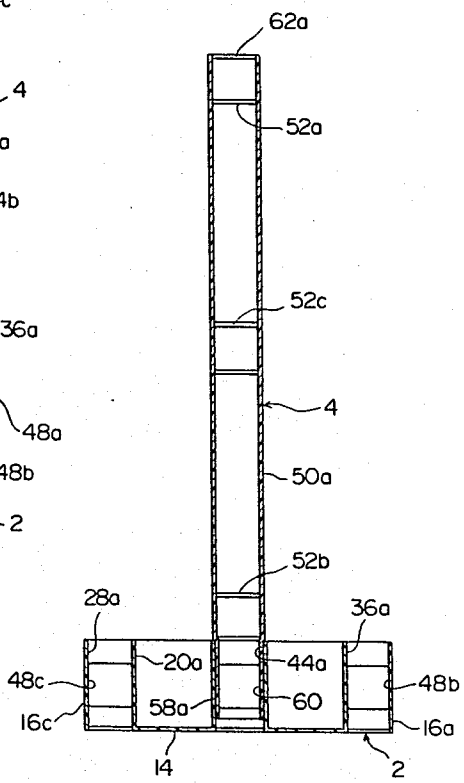
FIG. 13 is a sectional view taken on line XIII—XIII in FIG. 12.
Figure 12:
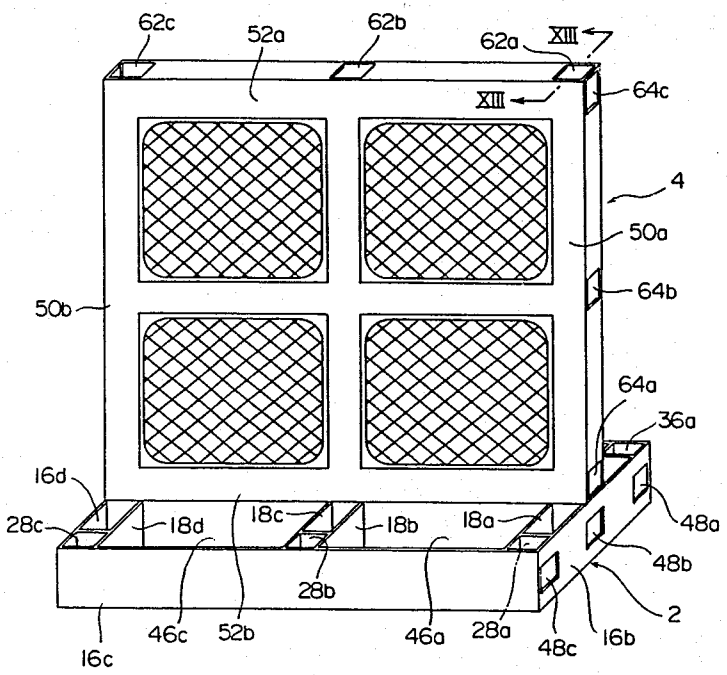
FIG. 12 is a perspective view showing a third assembling example of the assembly-type barricade of the invention.

FIGS. 12 and 13 shows a third assembling example using a combination of the base stand 2 and the first-type upright wall 4. In the third example, the base stand 2 is used in the second mode of use (in which the upper wall 14 makes contact with the ground), and the protruding means 56 of the upright wall 4 is inserted into the receiving means 26 of the base stand 2 from above.

In the third example, the barricade is assembled in substantially the same form as in the first assembling example, as can be easily seen by comparing FIGS. 7–9 with FIGS. 12–13. But it further has the following characteristic features. When the base stand 2 is used in the second mode, the hollow space of the base stand 2 is exposed to outside and therefore this space (particularly the depressed portions 46*a* to 46*d* shown in FIG. 2) can be effectively utilized for accommodating a weight. By placing a bag containing stones, sand, etc. in the weight accommodating space, the weight acting on the base stand 2 increase and it is possible to prevent the assembled barricade from flying or tumbling down by the pressure of the wind or otherwise.

To prevent the tumbling down of the barricade more accurately, it is also possible in the third assembling example to fit the linking vertical members through the linking vertical holes 62*a* to 62*c* of the first-type upright wall 4 and the through holes defining the assembling depressed portions 44*a* to 44*c* and embed the lower end portions of the linking vertical members in the ground, as shown in FIGS. 10 and 11.

Fourth Assembling Example

Figure 14:
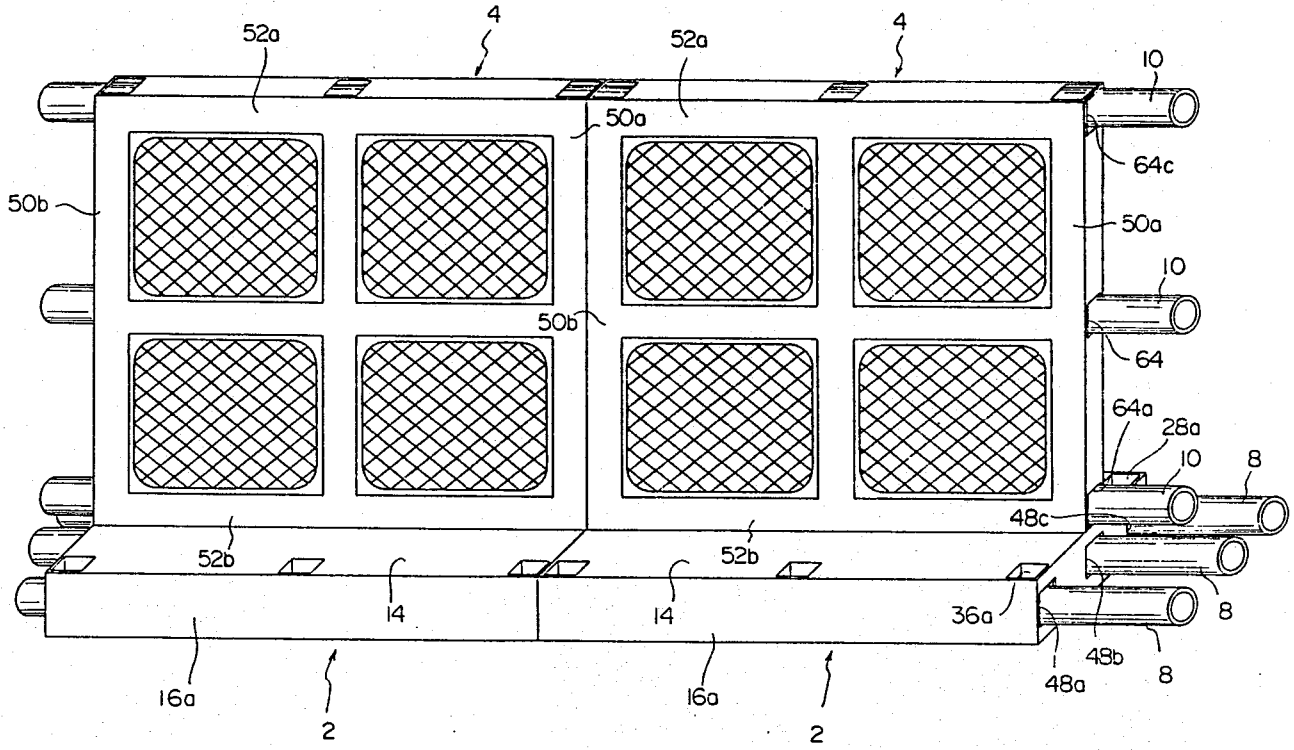
FIG. 14 is a perspective view showing a fourth assembling example of the assembly-type barricade of the invention.

FIG. 14 shows a fourth assembling example using a combination basically composed of two base stands 2 and two first-type upright walls 4. As can be seen easily from FIG. 14, in the fourth assembling example, the base stands 2 and the upright walls 4 are assembled respectively as shown in FIGS. 7 to 9 and then aligned continuously in a predetermined direction, and further, the linking lateral members 8 and the wall linking lateral members 10 are fitted through the linking lateral holes 48*a* to 48*c* of the base stand 2 and the linking lateral holes 64*a* to 64*c* of the upright wall 4. Specifically, the linking lateral members 8 are detachably fitted through the linking lateral holes 48*a* to 48*c* of one base stand 2 and linking lateral holes (not shown) of the other base stand 2. The linking lateral members 8 mainly link the base stands 2 to each other and also act as a weight for the assembled barricade. In particular, these linking lateral members 8 act to lower the center of gravity of the barricade and prevent the barricade from being tumbled down by the pressure of the wind or otherwise. Since the linking lateral member 8 fitted through the linking lateral hole 48*b* extends through the linking lateral hole 60 formed in the assembling protrusions 58*a* to 58*c* of the upright wall 4, it also acts to accurately link the base stand 2 to the upright wall 4, and accurately prevents the upright wall 4 from being detached from the base stand 2. The wall-linking lateral members 10 are detachably fitted through the linking lateral holes 64*a* to 64*c* of one upright wall 4 and linking lateral holes (not shown) of the other upright wall 4, and act mainly to link the upright walls 4 to each other.

In the fourth assembling example, the linking lateral members 8 are fitted in the linking lateral holes 48*a* to 48*c*, and the wall-linking lateral members 10, in the linking lateral holes 64*a* to 64*c*. This is not limitative, however. The desired effect can be achieved also by using one or two linking lateral members 8 and one or two wall-linking lateral members 10. Furthermore, in the fourth example, two basic forms shown in FIGS. 7 to 9 are aligned continuously in a predetermined direction. If desired, however, three or more such basic forms may be aligned continuously.

Fifth Assembling Example

Figure 15:
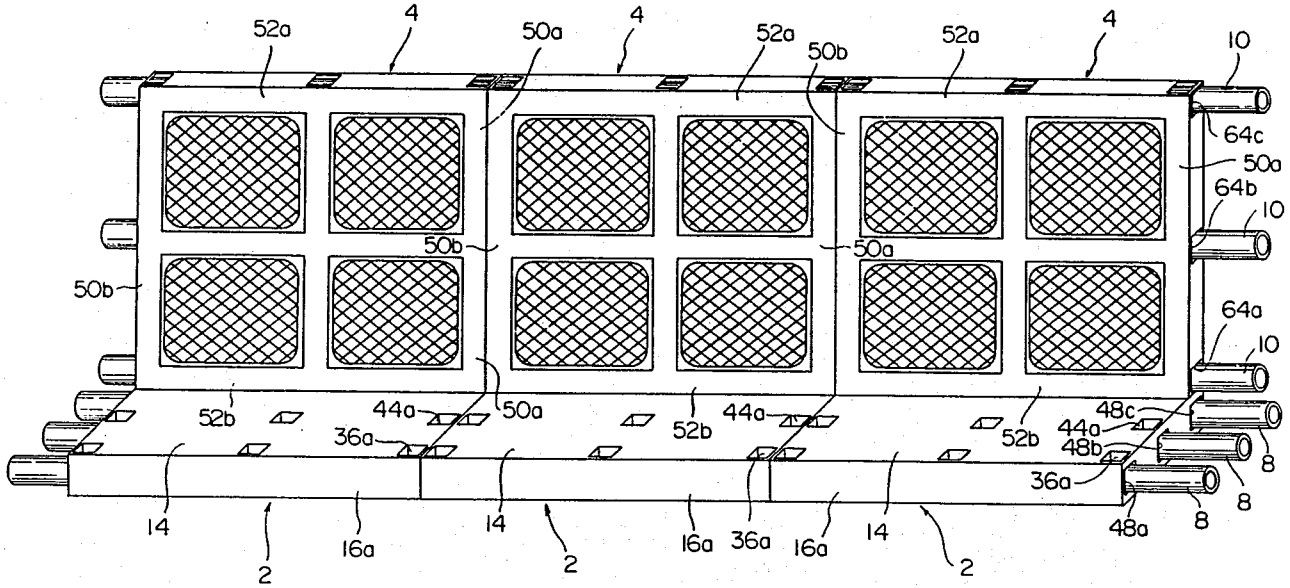
FIG. 15 is a perspective view showing a fifth assembling example of the assembly-type barricade of the invention.

FIG. 15 shows a fifth assembling example using a basic combination of three base stands 2 and three first-type upright walls 4. In the fifth example, the protruding means 56 (assembling protrusions 58*a* to 58*c*) of each upright wall 4 are inserted from above into the receiving means 22 (assembling depressed portions 28*a* to 28*c*) of the corresponding base stand 2. The resulting units are then aligned continuously in a predetermined direction and the linking lateral members 8 and the wall linking lateral members 10 are respectively fitted through the linking lateral holes 48*a* to 48*c* formed in the base stands 2 and the linking lateral holes 64*a* to 64*c* formed in the upright walls 4. It will be easily understood by comparing FIG. 14 with FIG. 15 that in the fifth assembling example, the upright wall 4 does not exist in an intermediate portion of the base stand 2 in the lateral direction, but extends substantially vertically from one side edge portion of the base stand 2. Hence, the base stand 2 does not substantially project from one surface (the hidden surface in FIG. 15) of the upright wall 4. When it is desired to prevent the base stands 2 from projecting to a vehicle road, this method of assembling is preferred. In the fifth example, too, the linking lateral members 8 mainly serve to link the base stands 2 to each other and also act as a weight for the assembled barricade. In particular, the linking lateral member 8 fitted through the linking lateral hole 44*c* also acts to link the base stand 2 and the upright wall 4 accurately because it extends through the linking lateral hole 60 formed in the assembling protrusions 58*a* to 58*c* formed in the upright wall 4. The wall-linking lateral members 10 mainly act to link the upright walls 4 to each other.

As is seen from FIG. 15, the linking lateral members 8 and the wall-linking lateral members 10 extend all the way through the base stand 2 and the upright wall 4 on one side (on the right side in FIG. 15), the base stand 2 and the upright wall 4 located intermediately, and the base stand 2 and the upright wall 4 located on the left side (on the left side in FIG. 15). For the convenience of assembling, two short linking lateral members 8 and two short wall-linking lateral members 10 may be used instead of one member 8 and one member 10. Specifically, one may insert one short linking lateral member 8 and one short wall-linking lateral member 10 from the base stand 2 and the upright wall 4 on one side to the intermediate portions of the base stand 2 and the upright wall 4 located at an intermediate portion, and the other short linking lateral member 8 and the other short wall-linking lateral member 10 from the base stand 2 and the upright wall 4 on the other side to the intermediate portions of the base stand 2 and the upright wall 4 located at an intermediate portion. In the illustrated embodiment, three combinations each consisting of the base stand 2 and the upright wall 4 are continuously arranged in the predetermined direction. If desired, it is possible to use one combination, or two, four or more such combinations in succession.

Sixth Assembling Example

Figure 16:
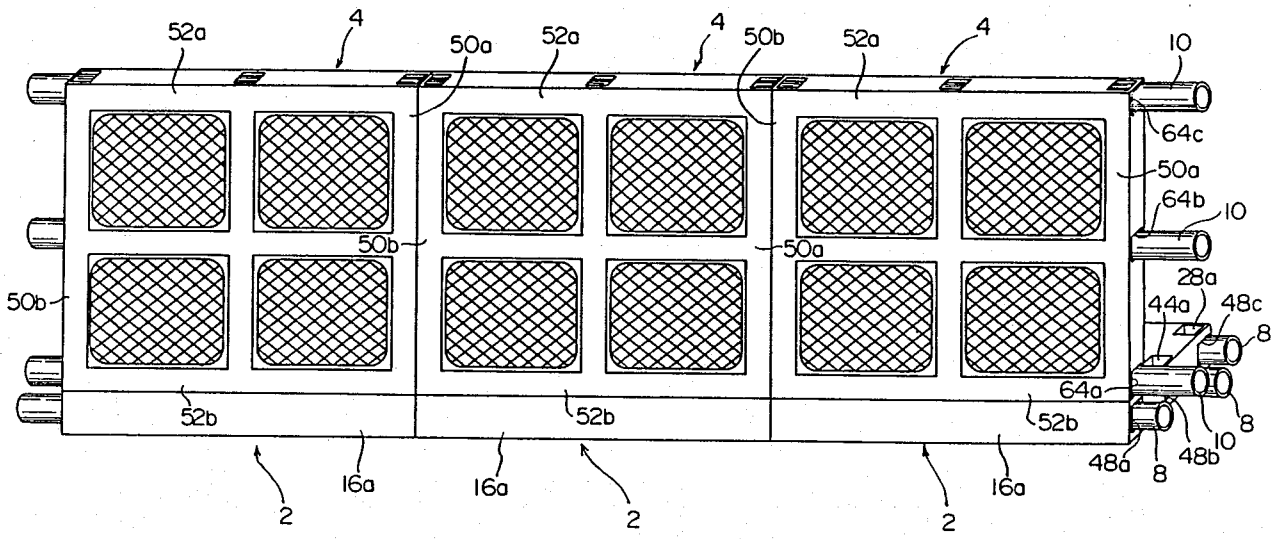
FIG. 16 is a perspective view showing a sixth assembling example of the assembly-type barricade of the invention.

FIG. 16 shows a sixth example of assembling using a combination basically composed of three base stands 2 and three first-type upright walls 4. In the sixth example, the protruding means 56 (the assembling protrusions 58*a* to 58*c*) are inserted from above into the receiving means 24 (the assembling depressed portions 36*a* to 36*c*) in the corresponding base stands 2. The resulting units are aligned continuously in a predetermined direction, and the linking lateral members 8 and the wall-linking lateral members 10 are fitted through the linking lateral holes 48*a* to 48*c* in the base stands 2 and the linking lateral holes 64*a* to 64*c* in the upright walls 4. It will be easily understood by comparing FIG. 15 with FIG. 16 that in the sixth assembling example, the assembled barricade is of substantially the same form as the fifth assembling example.

Seventh Assembling Example

Figure 17:
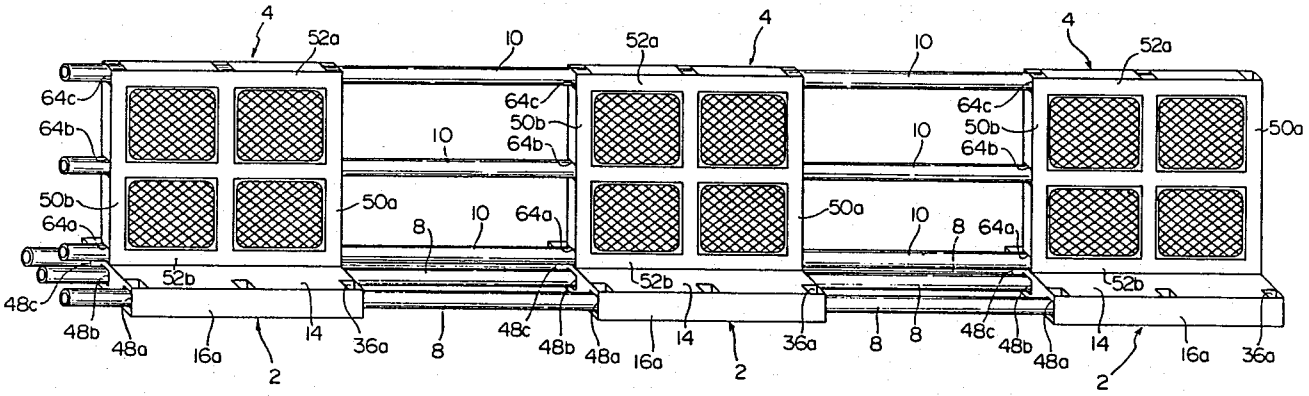
FIG. 17 is a perspective view showing a seventh assembling example of the assembly-type barricade of the invention.

FIG. 17 shows a seventh assembling example using a combination basically composed of three base stands 2 and three first-type upright walls 4. It will be easily understood from FIG. 17 that in the seventh assembling example, the base stands 2 and the upright walls 4 are assembled as shown in FIGS. 7 to 9 and aligned in a predetermined direction in spaced-apart relationship, and the linking lateral members 8 and the wall-linking lateral members 10 are fitted between adjacent base stands 2 and upright walls 4. Specifically, one end portion of each linking lateral member 8 is inserted into the linking lateral hole 48*a*, 48*b* or 48*c* formed in the adjacent one (right in FIG. 17) base stand 2, and the other end portion of each linking lateral member 8 is inserted into the linking lateral hole 48*a*, 48*b* or 48*c* formed in the adjacent other (left in FIG. 17) base stand 2. Accordingly, the linking lateral members 8 mainly link the base stands 2 and act also as a weight for the assembled barricade. In particular, the linking lateral member 8 fitted through the linking lateral hole 48*b* also acts to link the base stand 2 and the upright wall 4 accurately. Furthermore, one end portion of each wall linking lateral member 10 is inserted into the linking lateral hole 64*a*, 64*b* or 64*c* of the adjacent one (right in FIG. 17) upright wall 4, and the other end portion of each wall-linking lateral member 10 is inserted into the linking lateral hole 64*a*, 64*b* or 64*c* of the adjacent other (left in FIG. 17) upright wall 4. The wall-linking lateral members 10 mainly act to link the upright walls 4 to each other and also serve as a shelf portion between the adjacent upright walls 4. The wall-linking lateral members 10 inserted into the linking lateral holes 64*b* and 64*c* of the upright wall 4 particularly function as such a shelf portion.

It will be easily understood by comparing FIG. 14 with FIG. 17 that in the seventh assembling example, mainly the wall-linking lateral members 10 function effectively as a shelf portion, and therefore that in building up a barricade of a predetermined length, the numbers of the base stands 2 and the upright walls 4 used per unit length can be decreased.

In the seventh assembling example, three basic combinations shown in FIGS. 7 to 9 are aligned in the predetermined direction in spaced-apart relationship. If desired, it is also possible to align two such basic combinations or four or more such basic combinations in spaced-apart relationship. In the seventh example, the protruding means 56 (the assembling protrusions 58*a* to 58*c*) are inserted into the receiving means 26 (the assembling depressed portions 44*a* to 44*c*) of the base stand 2. Depending upon the situation in which the resulting barricade is used, the protruding means 56 of the upright wall 4 may be inserted into the receiving means 22 (the assembling depressed portions 28*a* to 28*c*) or the receiving means 24 (the assembling depressed portions 36*a* to 36*c*) of the base stand 2.

Eighth Assembling Example

Figure 18:
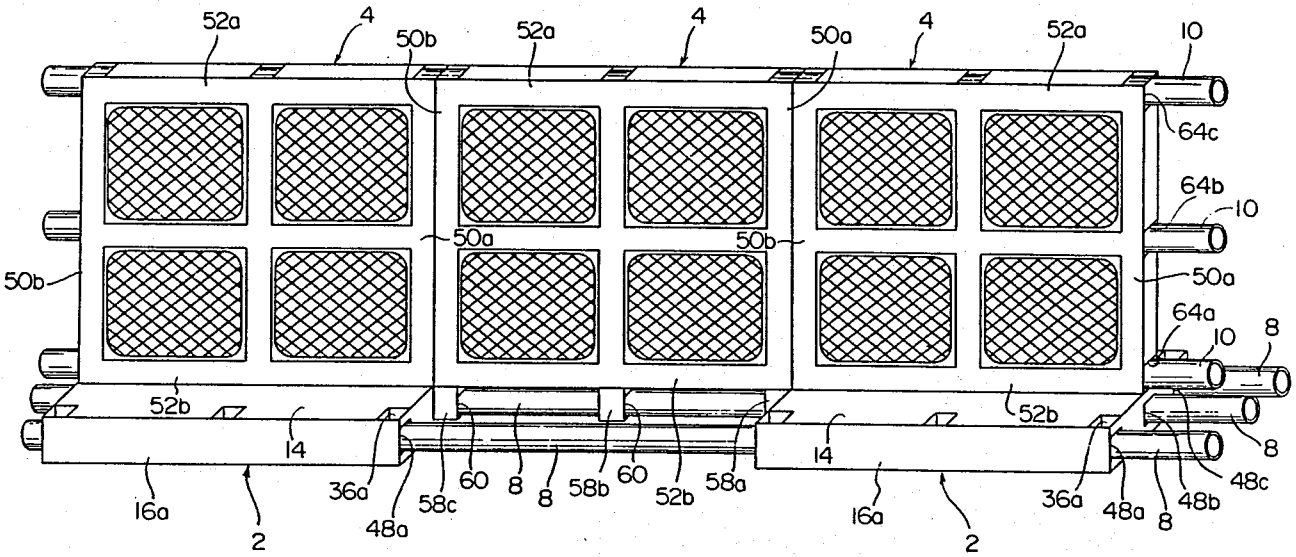
FIG. 18 is a perspective view showing an eighth assembling example of the assembly-type barricade of the invention.

FIG. 18 shows an eighth assembling example using a combination basically composed of two base stands 2 and three first-type upright walls 4. It will be easily seen from FIG. 18 that in the eighth example, two base stands 2 and two upright walls 4 are assembled respectively as shown in FIGS. 7 to 9, and one upright wall 4 is positioned between the assembled units, and thereafter, the linking lateral members 8 and the wall-linking lateral members 10 are fitted through the linking lateral holes 48*a* to 48*c* of the base stands 2 and the linking lateral holes 64*a* to 64*c* of the upright walls 4. Specifically, each linking lateral member 8 extends from the linking lateral hole 48*a*, 48*b* or 48*c* in one (right in FIG. 18) base stand 2 to the linking lateral hole 48*a*, 48*b* or 48*c* of the other (left in FIG. 18) base stand 2. Hence, the linking lateral members 8 mainly link the base stands 2 to each other and also act as a weight for the assembled barricade. In particular, the linking lateral member 8 fitted through the linking lateral hole 48*b* acts to link the assembling protrusions 58*a* to 58*c* between the two adjacent base stands 2 because it extends through the linking lateral hole 60 formed in the assembling protrusions 58*a* to 58*c* of the upright wall 4. Each wall-linking lateral member 10 extends from the linking lateral hole 64*a*, 64*b*, or 64*c* of one (right in FIG. 18) upright wall 4 to the linking lateral hole 64*a*, 64*b* or 64*c* of the other (left in FIG. 18) upright wall 4 via the linking lateral hole 64*a*, 64*b* or 64*c* of the intermediate upright wall 4. Hence, the wall-linking lateral members 10 mainly act to link the upright walls 4 to each other.

It will be seen by comparing FIG. 14 with FIG. 18 that in the eighth example, the base stands are spaced from each other, and therefore that in spite of having the continuously aligned upright walls 4, the number of the base stands 2 used can be decreased.

In the eighth example, one upright wall 4 is disposed between two basic units of the form shown in FIGS. 7 to 9. Alternatively, two or more upright walls 4 may be disposed between them. It is also possible to use the assembly built up in the eighth example as a unit and link a plurality of such units in a predetermined direction. Furthermore, a plurality of such basic units and a plurality of upright walls 4 may be linked alternately. In the eighth example, the protruding means 56 (the assembling protrusions 58*a* to 58*c*) of the upright wall 4 are inserted into the receiving means 26 (the assembling depressed portions 44*a* to 44*c*) of the base stand 2. Depending upon the situation in which the assembled barricade is used, the protruding means 56 of the upright wall 4 may be inserted into the receiving means 22 (the assembling depressed portions 28*a* to 28*c*) or the receiving means 24 (the assembling depressed portions 36*a* to 36*c*).

Ninth Assembling Example

Figure 19:
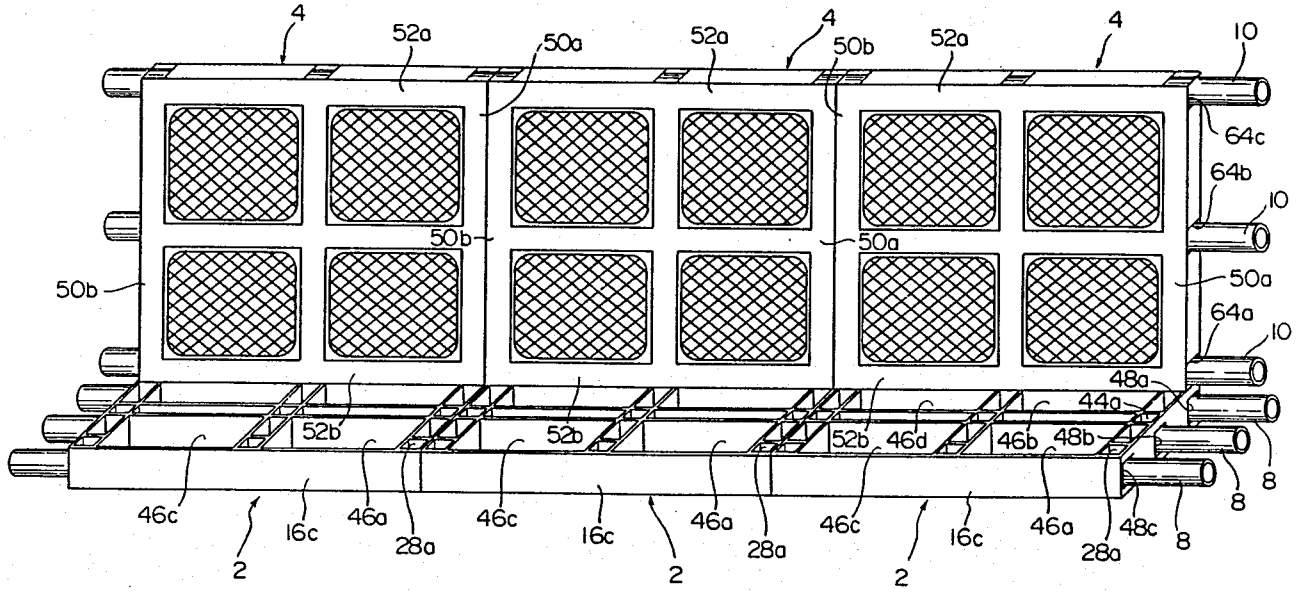
FIG. 19 is a perspective view showing a ninth assembling example of the assembly-type barricade of the invention.

FIG. 19 shows a ninth assembling example using a combination basically composed of three base stands 2 and three first-type upright walls 4. In the ninth example, the base stands are used in the second mode. The protruding means 56 (the assembling protrusions 58*a* to 58*c*) of the upright walls 4 are inserted into the receiving means 24 (the assembling depressed portions 36*a* to 36*c*) of the base stands 2, and the resulting units are continuously aligned in a predetermined direction. Furthermore, the linking lateral members 8 and the wall-linking lateral members 10 are fitted through the linking lateral holes 48*a* to 48*c* of the base stands 2 and the linking lateral holes 64*a* to 64*c* of the upright walls 4.

In the ninth example, the assembled barricade is of substantially the same form as in the fifth assembling example as can be seen by comparing FIG. 15 with FIG. 19. Since the hollow spaces of the base stands are exposed to outside, this example is also characterized in that such spaces (especially the depressed portions 46*a*, 46*b*, 46*c* and 46*d*) can be effective utilized for accommodating a weight.

In the ninth example, all of the base stands 2 are used in the second mode. It is possible however to use some of them in the second mode and the remainder in the first mode.

It will be easily appreciated also that the base stands 2 may, partly or wholly, be used in the second mode instead of the first mode in the fourth assembling example shown in FIG. 14, the sixth assembling example shown in FIG. 16, the seventh assembling example shown in FIG. 17, the eighth assembling example shown in FIG. 18 and a tenth assembling example to be described below.

Tenth Assembling Example

Figure 20:
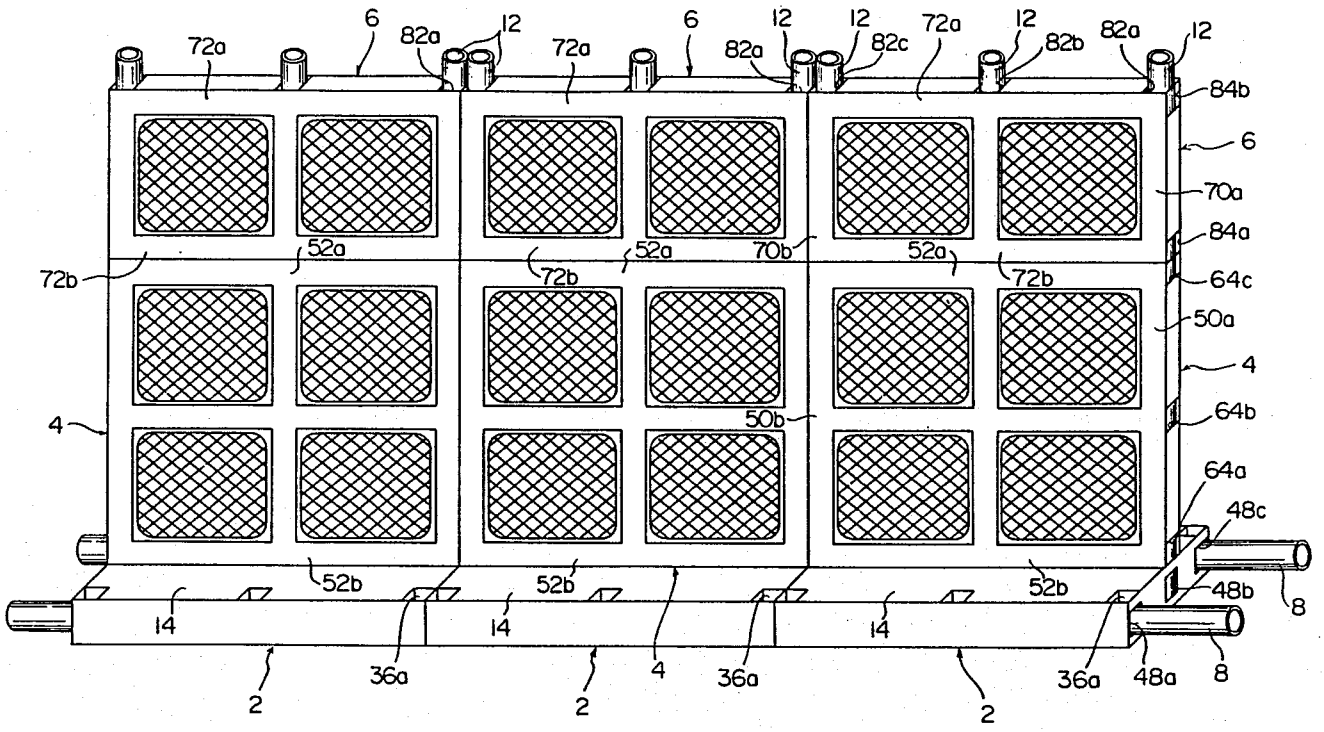
FIG. 20 is a perspective view showing a tenth assembling example of the assembly-type barricade of the invention.

FIG. 20 shows a tenth assembling example using a combination composed basically of three base stands 2, three first-type upright walls 4 and three second-type uprignt walls 6. It will be easily understood from FIG. 20 that the base stands 2 and the upright walls 4 are each assembled in the basic form shown in FIGS. 7 to 9 and then the upright walls 6 are mounted on the upper ends of the upright walls 4. The resulting assembled units are continuously aligned in a predetermined direction, and the linking lateral members 8 and the linking vertical members 12 are fitted through the linking lateral holes 48*a* to 48*c* of the base stands 2 and the linking vertical holes 62*a* to 62*c*, 82*a* to 82*c* of the upright walls 4 and 6. Mounting of the upright walls 6 on the upright walls 4 is achieved by positioning the protruding means 76 (the assembling protrusions 78*a* to 78*c*) (FIG. 5) provided in the upright walls 6 in the linking vertical holes 62*a* to 62*c* provided in the upright walls 4. The linking lateral members 8 extend from the linking lateral holes 48*a* to 48*c* of one (right in FIG. 20) base stand 2 to the linking lateral holes 48*a* to 48*c* of the other (left in FIG. 20) base stand 2 via the linking lateral holes 48*a* to 48*c* of the intermediate base stand 2. Hence, the linking lateral members 8 mainly act to link the base stands 2 to each other and also serve as a weight for the assembled barricade. The linking vertical members 12 extend through the linking vertical holes 82*a* to 82*c* of the upright walls 6, the linking vertical holes 62*a* to 62*c* of the upright walls 4 and the through holes defined by the assembling depressed portions 44*a* to 44*c*. Accordingly, the linking vertical members 12 mainly act to link the upright walls 6, the upright walls 4 and the base stands 2 to one another. Preferably, the lower end portions of the linking vertical members 12 are embedded in the ground as shown in FIGS. 10 and 11. This accurately prevents the barricade from falling down by the pressure of the wind or by another cause.

As can be understood from FIG. 20, when the linking vertical members 12 are fitted, the linking lateral members 8 and the wall-linking lateral members 10 cannot be fitted through the linking lateral holes 48*b* of the base stands, the linking lateral holes 64*a* to 64*c* of the upright walls 4 and the linking lateral holes 84*a* and 84*b* of the upright walls 6. Instead of the linking vertical members 12, the linking lateral members 8 and the wall-linking lateral members 10 may be fitted through the above linking lateral holes. When the linking lateral member 8 is fitted through the linking lateral holes 48*b* of the base stands 2, it links the base stands 2 to each other and also acts to link the base stands 2 and the upright walls 4 because it extends through the linking lateral hole 60 (FIG. 4) formed in the assembling protrusions 58*a* to 58*c* of the upright walls 4. When the wall-linking lateral member 10 is fitted through the linking lateral holes 64*c* of the upright walls 4, it also links the upright walls 4 to each other and also acts to link the upright walls 4 to the upright walls 6 because it extends through the linking lateral hole 80 (FIG. 5) formed in the assembling protrusions 78*a* to 78*c* of the upright walls 6.

It will be easily understood by comparing FIG. 14 with FIG. 20 that in the tenth assembling example, the height of the upright to walls can be increased. When it is desired to increase the height of the upright walls further, first-type upright walls 4 and/or second-type uprigt walls 6 may be stacked further.

In the tenth assembling example, the protruding means 56 (the assembling protrusions 58*a* to 58*c*) of the upright wall 4 are inserted into the receiving means 26 (the assembling depressed portions 44*a* to 44*c*) of the base stand 2. Depending upon the situation in which the final assembled barricade is used, the protruding means may be inserted into the receiving means 22 (the assembling depressed portions 28*a* to 28*c*) or the receiving means 24 (the assembling depressed portions 36*a* to 36*c*). Alternatively, one unit composed of the base stand 2 and the upright walls 4 and 6 may be used, or two, four or more such units may be linked to each other.

While the present invention has been described hereinabove with regard to one specific embodiment of the assembly-type barricade constructed in accordance with this invention, it should be understood that the invention is not limited to this specific embodiment, and various changes and modifications are possible without departing from the scope of the invention.

For example, in the specific embodiment, each receiving means is constructed of three assembling depressed portions. If desired, it may be comprised of two, four or more assembling depressed portions. The protruding means may accordingly be comprised of two, four or more assembling protrusions corresponding to the assembling depressed portions.

In the illustrated embodiment, three receiving means are provided in the base stand. If desired, one, two, four or more receiving means may be provided.

In the illustrated embodiment, three linking lateral holes are provided in the base stand. The number of the linking lateral holes may be four or more, or these holes may be provided in two stages. In this arrangement, by inserting linking lateral members acting as a weight into these linking lateral holes, the stability of the assembled barricade can be further increased. Furthermore, four or more linking vertical holes may be provided in the upright wall as is the case with the linking lateral holes.

In the illustrated embodiment, receiving means are provided in the base stand and protruding means are provided in the first-type and second-type upright walls. If desired, it is possible to provide the protruding means in the base stand and the receiving means in the first-type and second-type upright walls.

What we claim is:

1. An assembly-type barricade comprising a base stand which is set as desired, and an upright wall which is mounted detachably on the base stand, wherein a plurality of assembling protrusions spaced from each other in a predetermined direction are provided in the bottom surface of the upright wall, a plurality of assembling through holes spaced from each other in a predetermined direction are formed in the base stand in correspondence to the plural assembling protrusions linking lateral holes are formed respectively in the plural assembling protrusions so as to extend therethrough, linking lateral holes are formed in the upper end portion of the upright wall so as to extend therethrough, and linking lateral holes are formed in the plural assembling through holes of the base stand so as to extend therethrough, linking vertical holes extending vertically through the upright wall and the plural protrusions are formed in the upright wall in correspondence to the plural protrusions, said plural protrusions of the upright wall being detachably insertable through the plural through holes of the base stand to a position where the linking lateral holes formed in the plural assembling protrusions and the linking lateral holes formed in the base stand are aligned laterally, and at the same time the plural linking vertical holes communicate with the plural through holes of the base stand, said plural protrusions of the upright wall being detachably insertable through the plural linking vertical holes of another said upright wall to a position where the linking lateral holes formed in the plural protrusions of the upright wall and the linking lateral holes formed in said another upright wall are aligned laterally, and at the same time the plural linking vertical holes of the upright wall and the plural linking vertical holes of said another upright wall communicate with each other vertically.

2. The barricade of claim 1 wherein the plural assembling through holes are provided in plural pairs in spaced-apart relationship in a direction substantially perpendicular to said predetermined direction.

* * * * *